US010772359B2

(12) United States Patent
Hon

(10) Patent No.: US 10,772,359 B2
(45) Date of Patent: Sep. 15, 2020

(54) ELECTRONIC CIGARETTE

(71) Applicant: FONTEM HOLDINGS 1 B.V., Amsterdam (NL)

(72) Inventor: Lik Hon, North Point (HK)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 70 days.

(21) Appl. No.: 16/205,829

(22) Filed: Nov. 30, 2018

(65) Prior Publication Data

US 2019/0090550 A1 Mar. 28, 2019

Related U.S. Application Data

(60) Division of application No. 14/516,444, filed on Oct. 16, 2014, now Pat. No. 10,143,234, which is a (Continued)

(51) Int. Cl.

| | |
|---|---|
| ***A24F 47/00*** | (2020.01) |
| ***B01F 3/04*** | (2006.01) |
| ***H05B 3/22*** | (2006.01) |

(52) U.S. Cl.

CPC ..... *A24F 47/008* (2013.01); *A24F 47/00* (2013.01); *B01F 3/04007* (2013.01); *B01F 3/04014* (2013.01); *H05B 3/22* (2013.01)

(58) Field of Classification Search

CPC .... B01F 3/04; B01F 3/04007; B01F 3/04014; A24F 47/008; A24F 47/00; H05B 3/22

See application file for complete search history.

(56) References Cited

U.S. PATENT DOCUMENTS

| | | | |
|---|---|---|---|
| 6,715,494 | B1 | 4/2004 | McCoy |
| 7,088,914 | B2 | 8/2006 | Whittle et al. |

(Continued)

FOREIGN PATENT DOCUMENTS

| | | | |
|---|---|---|---|
| CA | 2641869 | A1 | 5/2010 |
| CA | 2752255 | A1 | 8/2010 |

(Continued)

OTHER PUBLICATIONS

IP Office Brazil, Office Action for Brazilian Patent Application No. BR112014025991-7, dated Sep. 23, 2019. Informal English translation attached. 6 pages.

(Continued)

*Primary Examiner* — Robert A Hopkins

(74) *Attorney, Agent, or Firm* — Perkins Coie LLP; Kenneth H. Ohriner

(57) ABSTRACT

In an electronic cigarette, a mesh element is in contact with liquid storage. A heater is spaced apart from the mesh element and positioned to heat air which flows through the mesh element. The heated air vaporizes the liquid in or on the mesh. The vapor is inhaled by the user. A method of vaporizing a liquid in an electronic cigarette includes conducting liquid from a liquid storage to a mesh element. Electric current is supplied to a heater, optionally in response to sensing inhalation on the outlet or mouthpiece of the electronic cigarette. The heater heats air and the heated air is conducted through the mesh element, with the heated air vaporizing liquid on or in the mesh element. The vaporized liquid is entrained with the heated air and may then flow through or around the liquid storage to the mouthpiece.

17 Claims, 4 Drawing Sheets

Related U.S. Application Data continuation of application No. PCT/CN2012/000530, filed on Apr. 18, 2012.

(56) References Cited

U.S. PATENT DOCUMENTS

| | | | | |
|---|---|---|---|---|
| 8,091,558 | B2 | 1/2012 | Martzel | |
| 8,689,805 | B2 | 4/2014 | Hon | |
| 9,022,026 | B2 | 5/2015 | Fang | |
| 9,320,300 | B2 | 4/2016 | Hon | |
| 9,439,455 | B2 * | 9/2016 | Alarcon | A24F 47/008 |
| 2011/0011396 | A1 | 1/2011 | Fang | |
| 2011/0036346 | A1 | 2/2011 | Cohen et al. | |
| 2011/0232654 | A1 | 9/2011 | Mass | |
| 2012/0111347 | A1 | 5/2012 | Hon | |
| 2012/0279512 | A1 | 11/2012 | Hon | |

FOREIGN PATENT DOCUMENTS

| | | | |
|---|---|---|---|
| CN | 201018927 | Y | 2/2008 |
| CN | 201051862 | Y | 4/2008 |
| CN | 101228969 | A | 7/2008 |
| CN | 201379072 | Y | 1/2010 |
| CN | 202052669 | U | 11/2011 |
| DE | 19935706 | A1 | 2/2001 |
| DE | 102007011120 | A1 | 9/2008 |
| EP | 2404515 | A1 | 1/2012 |
| WO | 2009155734 | A1 | 12/2009 |
| WO | 2010091593 | A1 | 8/2010 |
| WO | 2010145805 | A1 | 12/2010 |
| WO | 2013040193 | A2 | 3/2013 |

OTHER PUBLICATIONS

Intellectual Prperty India, Examination Report for India Application No. 8238/CHENP/2014; dated Feb. 6, 2019; 7 pages.

European Patent Office, Extended European Search Report for European Application No. 12874753.2; dated Dec. 22, 2015; 7 pages.

Australian Government, IP Australia, Patent Examination Report No. 1 issued in Australian Patent Application No. 2012377326 (dated Nov. 18, 2015).

Canadian Intellectual Property Office, Office Action issued in CA Patent Application No. 2,869,712 (dated Apr. 20, 2016).

European Patent Office, European Search Report issued in EP Application No. 12874753.2 (dated Dec. 22, 2015).

European Patent Office, Office Action issued in EP Patent Application No. 12874753.2 (dated Jun. 21, 2017).

Japanese Patent Office, Notice of Grounds for Rejection for Japanese Patent Application No. 2017-194129 with English Translation (dated Jan. 22, 2019).

Japanese Patent Office, Office Action issued in JP Patent Application No. 2015-506059 (dated Jan. 27, 2016).

Japanese Patent Office, Office Action issued in JP Patent Application No. 2015-506059 (dated Mar. 29, 2017).

Japanese Patent Office, Office Action issued in JP Patent Application No. 2015-506059 (dated Sep. 7, 2016).

Korean Intellectual Property Office, Notice of Preliminary Rejection issued in KR Patent Application No. 10-2014-7032124 (dated Jun. 14, 2016).

Mexico IMPI, "Communication of the Substantive Examination Report" issued in MX Patent Application No. MX/a/2014/012649 (dated Feb. 15, 2017).

State Intellectual Property Office of the People's Republic of China, "The First Office Action" issued in CN Patent Application No. 201280072507.7 (dated Aug. 10, 2016).

State Intellectual Property Office of the People's Republic of China, "The Second Office Action" issued in CN Patent Application No. 201280072507.7 (dated Mar. 2, 2017).

State Intellectual Property Office of the People's Republic of China, "The Third Office Action" issued in CN Patent Application No. 201280072507.7 (dated Aug. 29, 2017).

State Intellectual Property Office, The P.R. China, The International Search Report and the Written Opinion issued in PCT International Application No. PCT/CN2012/000530 (dated Jan. 31, 2013).

Taiwan Intellectual Property Office, Second Office Action issued in Taiwan Patent Application No. 102110773 (dated Jun. 13, 2016).

Taiwan Patent Office, First Office Action issued in TW Patent Application No. 102110773 (dated Jan. 12, 2016).

The Patent Office of the Russian Federation, Official Action issued in Russian Patent Application No. 2014146157 (dated Apr. 22, 2016).

* cited by examiner

ELECTRONIC CIGARETTE

CROSS REFERENCE TO RELATED APPLICATIONS

This application is a division of U.S. patent application Ser. No. 14/516,444 filed Oct. 16, 2014 and now pending, which is a continuation of International Application No. PCT/CN2012/000530, filed Apr. 18, 2012, each of which is incorporated herein by reference in its entirety.

BACKGROUND

Electronic cigarettes are increasingly used by smokers as a substitute for real tobacco cigarettes. In general, electronic cigarettes use a wire coil heater to vaporize liquid nicotine, or other liquid substances. The user's inhalation on a mouthpiece may be detected by a sensor, causing an electronic circuit to supply electrical current from a battery to the heater. The liquid contacts the wire coil heater, which creates the vapor or mist. The user's inhalation typically also draws ambient air into one or more inlets in the electronic cigarette housing. The vapor is entrained in the air flow moving through the housing and is inhaled by the user.

Electronic cigarettes have many advantages over real tobacco cigarettes. Initially, the risks of lung cancer associated with real tobacco cigarettes is largely avoided, as the tar and other chemicals in tobacco linked to lung cancer are simply not present in an electronic cigarette. Electronic cigarettes generate vapor or mist, and not smoke. Consequently, there is no comparable second-hand smoke problem with use of electronic cigarettes. In addition, since there is no burning material in electronic cigarettes, the risk of fire is eliminated.

Many electronic cigarette designs have been proposed and used, with varying degrees of success. Existing designs though have various disadvantages, including short life, poor atomization, nonuniform vapor caused by different sizes of liquid drops, and overheated vapor. Accordingly, there is a need for an improved electronic cigarette.

SUMMARY OF THE INVENTION

A new electronic cigarette has now been invented that provides significant improvements over existing designs. In this new electronic cigarette, a mesh element is in contact with liquid storage. A heater is spaced apart from the mesh element and positioned to heat air which flows through the mesh element. The heated air vaporizes the liquid in or on the mesh. The vapor is inhaled by the user.

In another aspect, the heater may be positioned within a heater housing having an air passageway aligned with a central opening extending through the liquid storage. Alternatively, an annular flow path around the outside of the liquid storage may be used.

The present electronic cigarette may include a battery in the housing electrically connected to a flow sensor, a circuit board and the heater. A flow path through the housing may be formed via one or more inlets in the housing, a passageway containing the heater, and a central opening extending through the liquid storage to an outlet.

In a separate aspect, a method of vaporizing a liquid in an electronic cigarette includes conducting liquid from a liquid storage to a mesh element. Electric current is supplied to a heater, optionally in response to sensing inhalation on the outlet or mouthpiece of the electronic cigarette. The heater heats air and the heated air is conducted through the mesh element, with the heated air vaporizing liquid on or in the mesh element. The vaporized liquid is entrained with the heated air and may then flow through or around the liquid storage to the mouthpiece.

Other and further objects and advantages will become apparent from the following detailed description which is provide by way of example, and is not intended as a statement of the limits of the invention. The invention resides as well in sub-combinations of the elements and steps described.

BRIEF DESCRIPTION OF THE DRAWINGS

In the drawings, the same reference number indicates the same element in each of the views.

DETAILED DESCRIPTION

Figure 1:
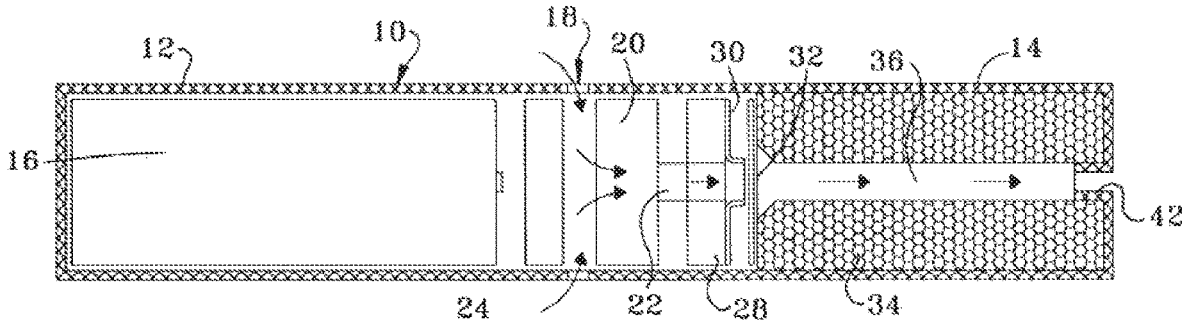
FIG. 1 is a section view of an electronic cigarette.
Figure 2:
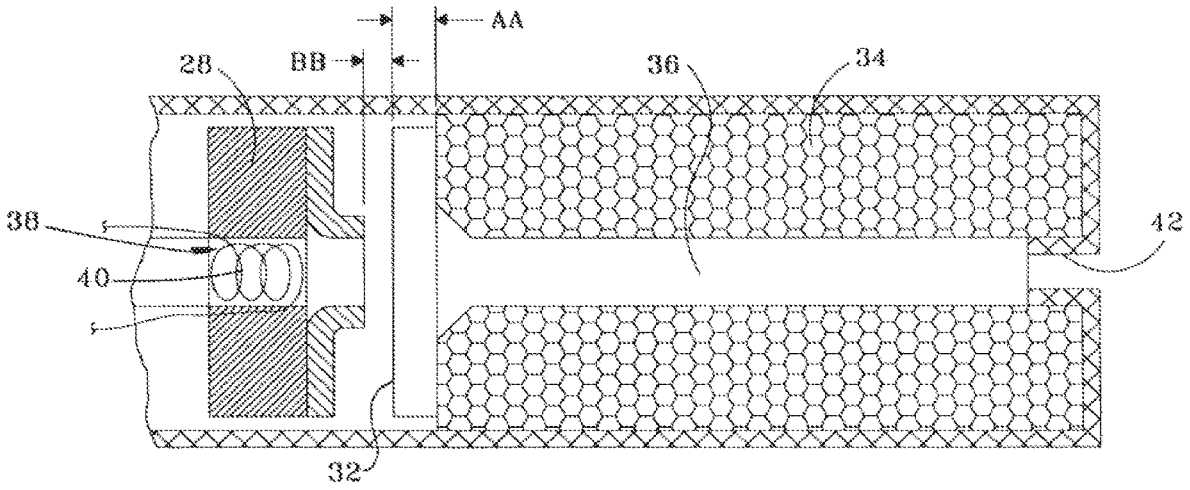
FIG. 2 is an enlarged detail view of components of the electronic cigarette shown in FIG. 1.

Turning now in detail to the drawings, as shown in FIGS. 1 and 2, and electronic cigarette has a housing 10 which optionally may be provided with a front section 12 attached to a back section 14 via screw threads or other attachment. A battery 16 and a circuit board 24 may be contained within the front section, with the circuit board electrically connected to a flow sensor 20 and to a heater coil 40, as further described in U.S. Patent Publication No. US2012-0111347 A1, incorporated herein by reference. A liquid storage 34 is contained within the back section 14 of the housing 10. The liquid storage 34 may be a fiber material, provided loose in bulk directly into the back section 14 of the housing, or it may be provided in or as part of a separate component or cartridge. The liquid storage may contain liquid nicotine, or another liquid for vaporization and inhalation. Other materials such as foam or porous metals or ceramics may optionally be used as the liquid storage 34.

The heater coil 40 may be positioned within a passageway 38 extending through a heater support 28. The heater housing, for example, a ceramic material, is fixed in place within the housing. An optional collector 30 may be attached to the back end of the heater support 28, with the passageway also extending centrally through the collector 30. The collector 30, if used, may be made of SILASTIC® silicone elastomers, or other high temperature inert silicon elastomers or plastic materials.

A mesh element or screen 32 on the front end of the liquid storage 34 is spaced slightly apart from the back end of the collector 30, by a dimension BB ranging from about 0.5 to 2 or 4 mm, and typically about 1 mm. The mesh 32 may be fiberglass, or other porous material, which the liquid in the liquid storage, such as liquid nicotine, can wick onto or through. The mesh 32 may have a thickness or dimension AA in FIG. 2 ranging from about 0.1 to 2 mm, 0.2 to 1 mm, or 0.3 to 0.6 mm, with a 4 mm thickness typical.

An opening 36 extends from the mesh 32 centrally through the liquid storage 34 to an outlet 42 at the back end of the housing 10. A flow path may be formed through the housing 10 via one or more inlets 18, a through opening in the sensor 20, the flow tube 22, the passageway 38 and the opening 36 leading to the outlet 42. Except as specified, the positions of the elements shown in the drawings is not critical, and the elements may be rearranged as needed or desired.

Referring still to FIGS. 1 and 2, in an example of use, the user inhales on the outlet 42. The sensor 20 detects the inhalation and supplies electrical current to the heater coil 40. Air is drawn into the flow path in the housing through the inlets 18. The flowing air passes through the passageway 38 and is heated by the heater coil 40. The amount of heating may vary by design. Air temperatures of 200 to 300° C. at the exit of the passageway, as one example, may be used by adjusting the power of the heater and the air flow characteristics through or past the heater. The collector 30, if used, may help to collect and direct the heated air to the mesh 32. The collector 30 may also be used to space the heater coil 40 and the heater support 28 apart from the mesh 32. The collector may optionally be made part of the heater support 28.

The mesh 32 is provided as a thin sheet or layer, and has a sufficiently open structure, so that the heated air can pass through without excessive flow resistance. The mesh 32 may be a sheet or layer of loose fiberglass, fiberglass fabric or similar material that can wick and hold liquid on the surface of the fibers, and/or in the gaps between the fibers, and also allow air to flow through. A heat resistant foam material may alternatively be used in place of the mesh.

The heated air flows through the mesh 32. This heats liquid in or on the mesh, which atomizes or vaporizes the liquid. The vapor is entrained in the heated air, which continues flowing from the mesh 32 through the opening 36 and the outlet 42, with the mixture of air and vapor inhaled by the user. The heated air may cool considerably as it passes through the mesh 32 and the opening 36, so that the user inhales air from the outlet at a comfortable temperature of e.g., 25 to 50° C.

Figure 3:
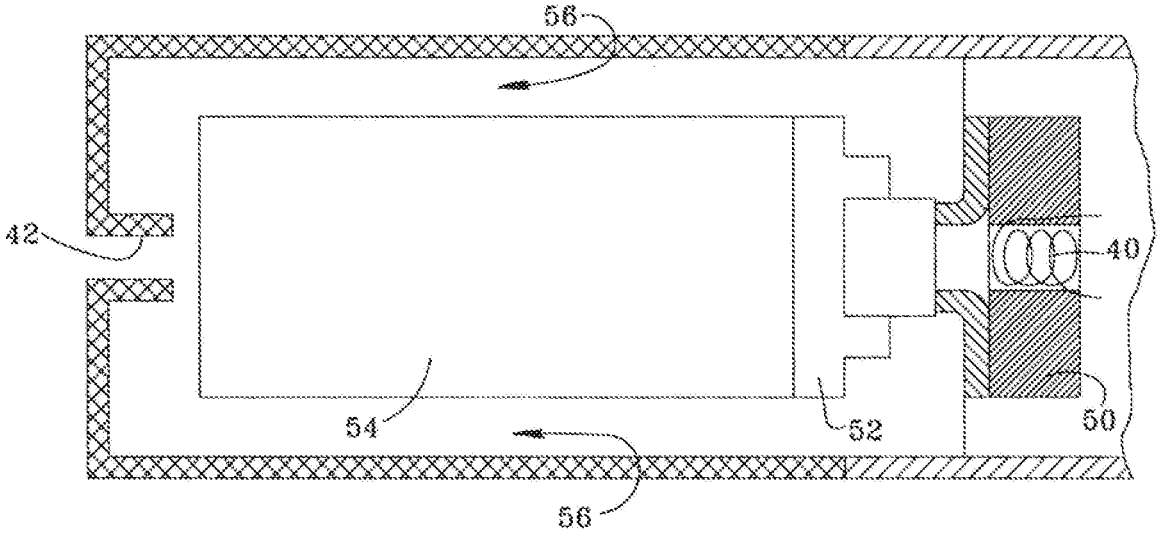
FIG. 3 is a schematic section view of an alternative embodiment.
Figure 4:
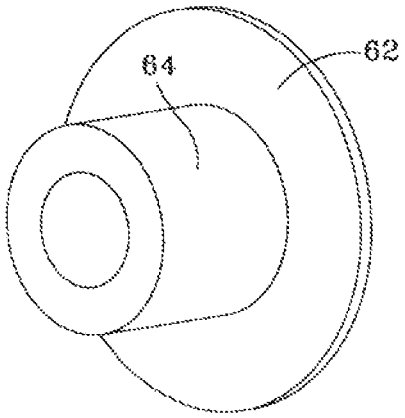
FIG. 4 is a perspective view of a component of the design shown in FIG. 3.

FIGS. 3 and 4 show an alternative design having a similar operation, but with the airflow path extending around the outside of a liquid storage element 54, rather than through the liquid storage, as in FIGS. 1 and 2. In the alternative design of FIGS. 3 and 4, the liquid storage is surrounded by an annular passage 56, leading from a woven or mesh tube 52 to the outlet 42. As also shown in FIGS. 3 and 4, the mesh tube 52 has a plate section 62 in contact with the liquid storage. A neck section 64 of the mesh tube 52 extends from the plate section 62 towards the heater 28. Liquid in the liquid storage 54 wicks through the plate section and into the neck section 64. Heated air diffusing radially outwardly through the neck section vaporizes the liquid creating a mist or vapor, which is drawn through the flow path 56 and inhaled by the user. The woven tube 52 may be produced by twill weave, and then cut with a hot blade, to prevent unraveling of cut end. Of course, the thin flat mesh component 32 shown in FIG. 2 may also be used in an embodiment having the annular passage 56 as shown in FIG. 3.

In the designs described above the liquid does not come into direct contact with the heater coil. This avoids the loss of heating efficiency resulting from deposits and liquid residue collecting on the heater coil 40. It also allows for longer heater coil life, as thermal shock to heater coil, and corrosion are reduced. Vaporization is also improved because the liquid is vaporized at lower temperatures. The heater coil itself may operate at temperatures in the range of 500° C. This can cause chemical changes in the liquid as it is vaporized. By avoiding contact between the heater coil and the liquid, and by vaporizing the liquid using heated air, chemical changes occurring during vaporization may be reduced.

In addition, since the heater coil 40 does not come into contact with the liquid, the heater coil may be plated with corrosion resistant materials, such as silver or nickel-chromium. Use of these types of materials, which would be degraded if contacted by the liquid, prolongs the life of the heater coil. Since the life of the heater coil can be much longer, the heater coil can be made as a reusable component, rather than be a disposable item as is common with existing designs. This allows for reduced costs.

With existing known electronic cigarettes, the heating device or coil must heat the nicotine liquid first, before the liquid can be vaporized. The present electronic cigarettes omit this initial step, as the heater coil 40 heats air, and not liquid. Consequently, the new designs described here also achieve faster vaporization in comparison to known designs.

Thus, novel designs have been shown and described. Various changes and substitutions may of course be made without departing from the spirit and scope of the invention. The invention, therefore, should not be limited, except by the following claims and their equivalents.

The invention claimed is:

1. A method of vaporizing a liquid, comprising:
conducting liquid from a liquid storage to a mesh element;
sensing inhalation;
providing electric current to a heater in response to sensing inhalation;
heating air via the heater;
conducting the heated air through the mesh element, with the heated air vaporizing liquid on or in the mesh element.

2. The method of claim 1 further including positioning the heater within a passageway in a heater housing, and drawing ambient air into the housing via an inlet in the housing, with the air passing through the passageway.

3. The method of claim 2 wherein the liquid storage has a central opening having a length at least five time greater than the length of the passageway.

4. The method of claim 1 with the air heated to 200 to 300° C. as it is conducted through the mesh element.

5. The method of claim 1 further comprising conducting the heated air through an annular passage surrounding the liquid storage, after the heated air passes through the mesh element.

6. The method of claim 1 with the liquid storage including a separate component or cartridge containing a liquid.

7. The method of claim 1 with the heater within a heater support having an air passageway aligned with a central opening extending through the liquid storage.

8. The method of claim 7 further including a collector on the heater support, with the collector spaced apart from the mesh element by less than 4 mm.

9. The method of claim 1 further comprising conducting the heated air through an annular flow path around the outside of the liquid storage.

10. The method of claim 1 with the mesh element comprising a fiber material having a thickness less than 2 mm.

11. The method of claim 1 further comprising sensing inhalation using a sensor electrically connected to a battery and a circuit board and heating the heater via electrical current from the battery.

12. A method of vaporizing a liquid, comprising:
conducting liquid from a liquid storage to a layer of fiber material;
sensing inhalation;
providing electric current to a heater in response to sensing inhalation;

heating air via the heater;

conducting the heated air through the layer of fiber material with the heated air vaporizing liquid on or in the fiber material.

13. The method of claim 12 wherein the layer of fiber material is flat and lies in a plane perpendicular to a cylindrical opening through the liquid storage, at a first end of the liquid storage.

14. The method of claim 13 with the heater between an air inlet and the liquid storage, the heater spaced apart from the layer of fiber material and positioned to heat air which flows through the layer of fiber material, and with the liquid not contacting the heater.

15. The method of claim 12 with the heated air flowing through a cylindrical opening in the liquid storage.

16. The method of claim 12 with the heated air flowing in an annular flow path around the liquid storage.

17. A method of vaporizing a liquid, comprising:

conducting liquid from a liquid storage to a mesh element;

sensing inhalation;

providing electric current to a heater in response to sensing inhalation;

heating air via the heater;

conducting the heated air through the mesh element, with the heated air vaporizing liquid on or in the mesh element; and entraining the vaporized liquid into the heated air to form a mixture of vaporized liquid and heated air, and flowing the mixture through a central opening in the liquid storage to an outlet.

* * * * *